US008882341B2

(12) United States Patent
Chu et al.

(10) Patent No.: US 8,882,341 B2
(45) Date of Patent: Nov. 11, 2014

(54) STRESS-RELIEF ELASTIC STRUCTURE OF HAIRSPRING COLLET

(71) Applicant: Master Dynamic Limited, Shatin (HK)

(72) Inventors: Siu Kay Chu, Shatin (HK); Ho Ching, Shatin (HK); Pui Hang Ko, Shatin (HK)

(73) Assignee: Master Dynamic Limited (HK)

( * ) Notice: Subject to any disclaimer, the term of this patent is extended or adjusted under 35 U.S.C. 154(b) by 0 days.

(21) Appl. No.: 14/154,055

(22) Filed: Jan. 13, 2014

(65) Prior Publication Data

US 2014/0198627 A1 Jul. 17, 2014

(30) Foreign Application Priority Data

Jan. 14, 2013 (HK) ..... 13100579

(51) Int. Cl.
*G04B 17/04* (2006.01)
*G04B 17/34* (2006.01)

(52) U.S. Cl.
CPC ..... *G04B 17/345* (2013.01)
USPC ..... 368/177

(58) Field of Classification Search
USPC ..... 368/128–133, 140, 144, 160, 168–178; 267/166, 273, 156
See application file for complete search history.

(56) References Cited

U.S. PATENT DOCUMENTS

| | | | | |
|---|---|---|---|---|
| 6,863,435 | B2 * | 3/2005 | Moteki et al. | 368/140 |
| 7,344,302 | B2 * | 3/2008 | Musy et al. | 368/175 |
| 8,393,783 | B2 * | 3/2013 | Daout et al. | 368/175 |
| 8,591,101 | B2 * | 11/2013 | Hiraoka et al. | 368/132 |
| 8,690,420 | B2 * | 4/2014 | Semon | 368/127 |
| 2005/0219957 | A1 | 10/2005 | Lambert et al. | |
| 2011/0310710 | A1 | 12/2011 | Karapatis et al. | |
| 2012/0106303 | A1 | 5/2012 | Von Gunten et al. | |

FOREIGN PATENT DOCUMENTS

FR 2 957 688 A1 9/2011

OTHER PUBLICATIONS

UK Intellectual Property Office, "Search Report Under Section 17", in connection with related U.K. Application No. H600083, Apr. 12, 2013, 7 pages.

* cited by examiner

*Primary Examiner* — Edwin A. Leon
(74) *Attorney, Agent, or Firm* — Kolisch Hartwell, P.C.

(57) ABSTRACT

A hairspring collet for a hairspring for interference engagement and an interference fit with the cylindrical outer surface of the staff of a balance wheel for a timepiece movement, the hairspring collet portion comprising a plurality of circumferentially extending elastically deformable interconnected arm portions, the arm portions forming an annulus having a central axis and providing an aperture therebetween, wherein each arm portion including a curved concave engagement portion for engagement with the outer surface of a staff of a balance wheel, wherein each engagement portion has substantially the same radius of curvature as each other and are equally spaced from the central axis at a first distance and wherein the first distance is less than the radius of the staff of the balance wheel; the engagement portions have a radius of curvature such that upon deformation of the arm portions and engagement with the outer surface of the staff the engagement portions substantially conform with the outer surface of the staff and an interference fit is formed therebetween, wherein stress induced from said interference fit is transferred and distributed from along the engagement portions to the arm portions adjacent the engagement portions and distributed therein; and wherein the interference fit of the engagement portions with the staff substantially prevents relative movement between the hairspring collet and the staff of the balance wheel upon application of load from a hairspring in use in a timepiece movement.

15 Claims, 10 Drawing Sheets

STRESS-RELIEF ELASTIC STRUCTURE OF HAIRSPRING COLLET

FIELD OF THE INVENTION

The present invention relates to a collet of a hairspring, more particularly to a collet designed to minimize stress induced during the assembly process with the balance staff to minimize failure fracture.

BACKGROUND OF THE INVENTION

In mechanical timepieces, a paramount one of the component that governs the movement is the hairspring, which it is assembled with the balance staff and the stud to form part of the oscillating system.

For high accuracy time estimation, recent technology utilized the technique of micro-fabrication to manufacture high quality hairsprings.

However, the fragility of such micro-fabricated hairsprings, which are often formed from brittle materials like silicon or quartz and having a relative low strength, increases the likelihood of failure by way of fracture.

During assembly, when a hairspring is press-fitted onto a balance staff, extreme high contact pressure induced in the contact region breaks the collet or renders the collet in a state of stress which may result in fatigue failure.

In order to minimize stress from press-fitting of the hairspring collet, a flexible structure may be incorporated. When a collet is fitted onto the balance staff, the flexible structure may provide a degree of elastic deformation in order to release or reduce a portion of the stress induced.

However, the parameters of such hairspring design in a timepiece when using micro-fabrication techniques utilising such brittle materials, dictate difficulties in providing a suitable timepiece from functional and structural standpoints:

i. if a collet is sufficiently tight so as to suitably engage with the staff, the resultant stress in the collet may induce fracture during assembly or usage, and ii. alternatively, if the collet allows for sufficient deformation to relieve the stress during assembly and usage, there may be insufficient frictional force to adequately secure the hairspring so as to resist rotational torque in use, the hairspring may not provide the functional requirements for a timepiece movement.

In respect of fracture issues associated with a hairspring collet, within the literature some have sought to reduce the induced stress by designing the collet having specific geometries. For example, U.S. Pat. No. 7,758,237 discloses a collet designed having elastic arms, wherein the arm width is varied along different positions with a view to providing improved stress distribution.

Others, such as in U.S. Pat. No. 7,926,355 disclose a collet that has an alternating arrangement of a rigid area and an elastic area such to optimize the gripping force against the press-fit stress.

Other manners within the literature to fix a collet to a staff and reduce the likelihood of fracture include providing a loose fit collet, whereby the assembly process is performed by using some adhesives to glue the components individually

OBJECT OF THE INVENTION

Accordingly, it is an object of the present invention to provide a collet for a hairspring that overcomes or at least ameliorates at least some of the deficiencies as associated with those of the prior art.

SUMMARY OF THE INVENTION

In a first aspect, the present invention provides a hairspring collet for a hairspring for interference engagement and an interference fit with the cylindrical outer surface of the staff of a balance wheel for a timepiece movement, said hairspring collet portion comprising a plurality of circumferentially extending elastically deformable interconnected arm portions, the arm portions forming an annulus having a central axis and providing an aperture therebetween, wherein each arm portion including a curved concave engagement portion for engagement with the outer surface of a staff of a balance wheel, wherein each engagement portion has substantially the same radius of curvature as each other and are equally spaced from said central axis at a first distance and wherein said first distance is less than the radius of the staff of the balance wheel; said engagement portions have a radius of curvature such that upon deformation of the arm portions and engagement with the outer surface of said staff the engagement portions substantially conform with the outer surface of said staff and an interference fit is formed therebetween, wherein stress induced from said interference fit is transferred and distributed along the engagement portions and distributed within the arm portions adjacent the engagement portions; and wherein the interference fit of the engagement portions with the staff substantially prevents relative movement between the hairspring collet and the staff of the balance wheel upon application of load from a hairspring in use in a timepiece movement.

Stress induced from said interference fit is preferably distributed along the engagement portions and transferred to the adjacent arm portions and the size and dimensions of the arm portions and the engagement portions are such that stress distributed within the arm portions is lower that the failure strength of the material from which the collet is formed.

Preferably the collet is formed as a unity construct by said arm portions.

Preferably, each elastically deformable interconnected arm portion is of equal arm width in the radial direction.

Preferably, the hairspring collet is formed from a brittle material including silicon quartz or the like.

The hairspring collet may further comprise a temperature compensation layer on the surface of the collet for time compensation due to changes in temperature. Preferably the temperature compensation layer is an addition layer of oxide.

The collet is preferably formed from micro-fabrication.

In a second aspect, the present invention provides a hairspring and hairspring collet assembly for a timepiece comprising a hairspring and a hairspring collet according to the first aspect.

Preferably, the collet is formed as a unity construct by said arm portions.

Preferably the hairspring inner coil is attached to the collet adjacent a juncture of two arm portions, and preferably the hairspring is formed with the collet as a unitary construct.

The hairspring and hairspring collet assembly is preferably formed from a brittle material including silicon quartz or the like.

Preferably the hairspring and hairspring collet assembly is formed from micro-fabrication.

The hairspring is preferably designed specifically according to specific frequency requisite of a timepiece.

In a third aspect, the present invention provides an engagement structure of a timepiece component for engagement with the cylindrical surface of a further timepiece component; said engagement structure comprising a plurality of circumferentially extending elastically deformable interconnected arm portions, the arm portions forming an annulus having a central axis and providing an aperture therebetween, wherein each arm portion including a curved concave engagement portion for engagement with the cylindrical surface of a further timepiece component, wherein each engagement portion has substantially same radius of curvature as each other and are equally spaced from said central axis at a first distance and wherein said first distance is less than the radius of the cylindrical surface; said engagement portions have a radius of curvature such that upon deformation of the arm portions and engagement with the cylindrical surface the engagement portions substantially conform with the outer surface of said cylindrical surface and an interference fit is formed therebetween, wherein stress induced from said interference fit is transferred and distributed along the engagement portions and distributed within the arm portions adjacent the engagement portions; and wherein the interference fit of the engagement portions with the cylindrical surface substantially prevents relative movement between the timepiece component and the further timepiece component in use in a timepiece movement.

The timepiece component may be an hour hand, minute hand, and the second hand or the like. It is an objective of this invention to solve the stress issue in assembling the hairspring with the balance staff by proposing a stress-relief elastic structure for the collet that could minimize the pressure acted by the balance staff at the collet contact zone.

BRIEF DESCRIPTION OF THE DRAWINGS

Preferred embodiments of the present invention will be explained in further detail below by way of examples and with reference to the accompanying drawings, in which:—

DETAILED DESCRIPTION OF THE PREFERRED EMBODIMENTS

Figure 1:
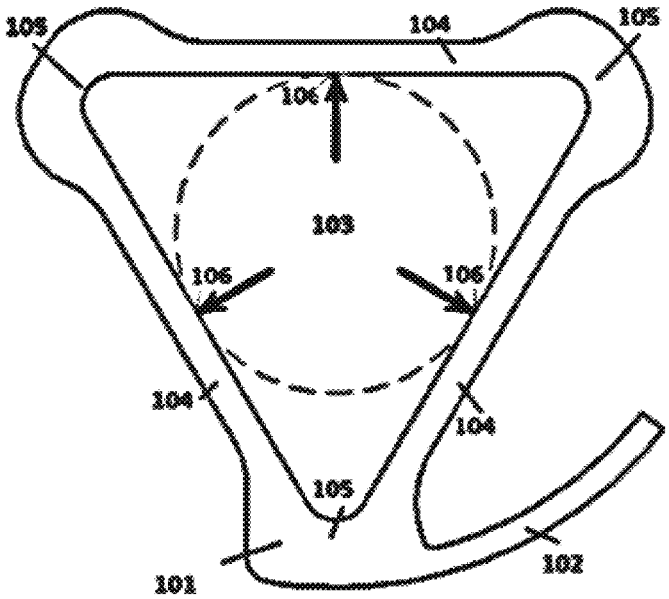
FIG. 1 shows a conventional hairspring collet of the Prior Art having an elastic structure design.

Referring to FIG. 1, there is schematically depicted a conventional hairspring collet according to the Prior Art. As shown, the component comprises a collet 101 attached with the hairspring inner coil 102 at one of the junctions 105. At the collet center, there is an open region 103 for a balance staff (represented by the dotted line) extend and fit in, upon bending and deformation of the elastic arms 104 adjacent the balance staff.

As the elastic arms 104 are constructed having generally a straight beam shape, contact with the balance staff in a very small contact region 106 (point contact), results in a very large, concentrated stress (represented by the 3 arrows) that may fracture and break the collet.

Figure 2A:
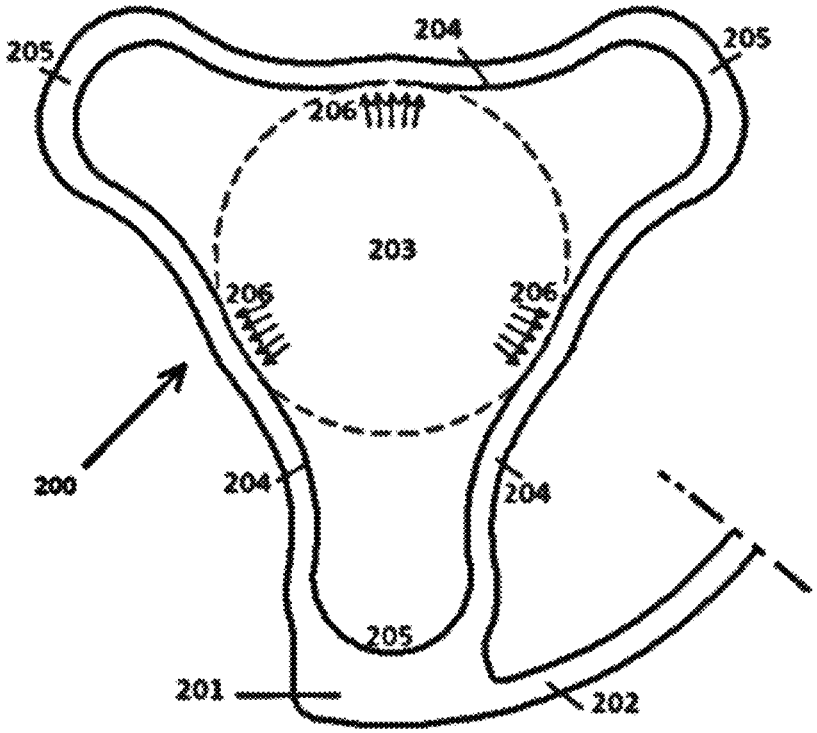
FIGS. 2*a* and 2*b* show a first embodiment of a collet according to the present invention.

FIG. 2*a* depicts a schematic representation of a first embodiment of a hairspring and collet 200 according to the present invention. The collet 200 of the stress-relief elastic structure, which reduces localised stresses in order to reduce the likelihood of fracture as associated with conventional hairspring collets.

As shown, the body of the hairspring and collet 200 comprises a collet portion 201 having three elastic arm portions 204 located adjacent the balance staff zone 203; and a hairspring 202 (extending radically outward) is adjoined at one of the elastic arm connection junctions 205.

Each elastic arm 204 is provided with specific curved geometry so as to provide preferential bending deformation, and also having a "cup" portion 206, which provides for reduction of localised stresses.

As shown in the enlarged view 2*b* of one of the contact regions, it is shown that the "cup" portion 206 is adapted to match the balance staff circumference (represented by the dotted line) to provide a close-fitting, enlarged contact surface.

Thus, the stress induced due to the press-fitting process of applying the collet 201 to the staff (represented by the arrows) is significant as contact area is one of the important factors which affect the resultant stresses.

Figure 3A:
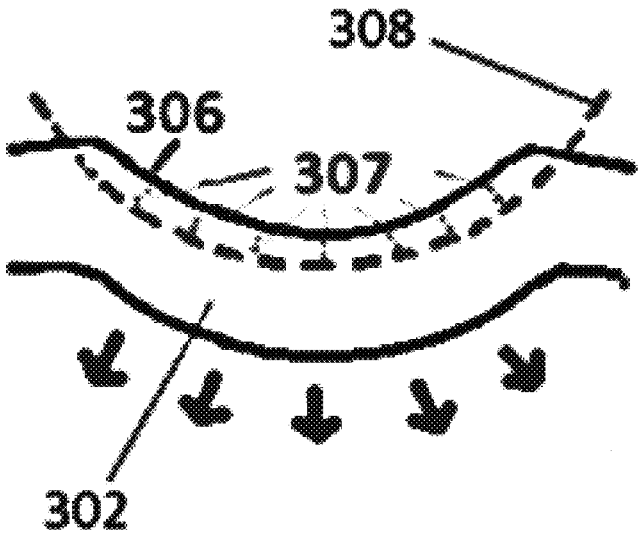
FIGS. 3*a* and 3*b* depict an enlarged portion of a collet according to the present invention.
Figure 3B:
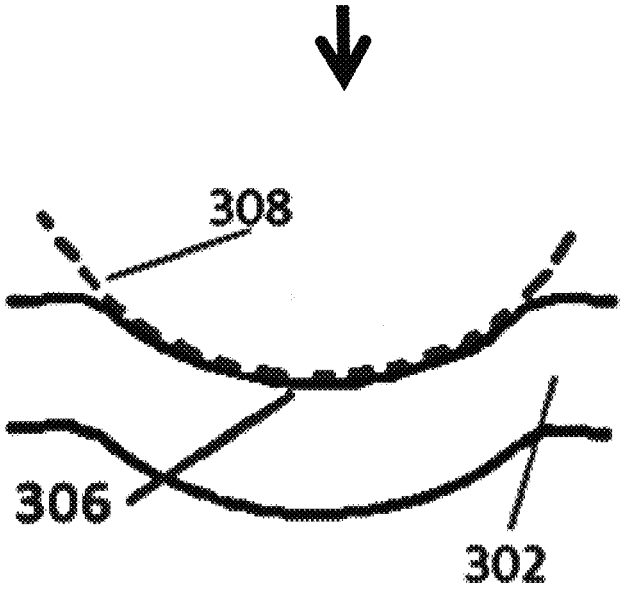

FIGS. 3*a* and 3*b* depict the working mechanism of the "cup" portion 306 of the collet 302 during engagement with a staff 308, whereby the stress-relief function as provided by the present invention.

In FIG. 3*a* there is shown an elastic arm of a collet 302 in accordance with the present invention, prior to commencement of the assembly process in an original position, whereby the collet is press-fitted into the staff 308.

The "cup" portion 306 of the collet 302 is designed such that at the middle section of the arm, the interference fit 307 is maintained at a constant value along the balance staff 308 circumference (represented by the dotted line).

When the press-fitting commences, the elastic arm, which is pushed by the balance staff 308, deforms radically outwardly from outward pushing force represented by the radially outwardly extending arrows until it extends from the balance staff domain.

During deformation, each point at the "cup" contact surface is displaced the same distance to reach onto the balance staff 308 surface. As shown in FIG. 3*b*, the "cup" portion 306, upon completion of the press-fit process and after deformation, is engaged with the balance staff 308 surface to produce an increased contact area. As the contact force is more evenly distributed along this surface, a lower stress is thus achieved.

Figure 2B:
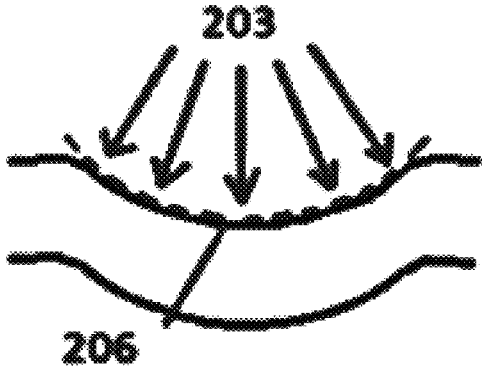
Figure 4A:
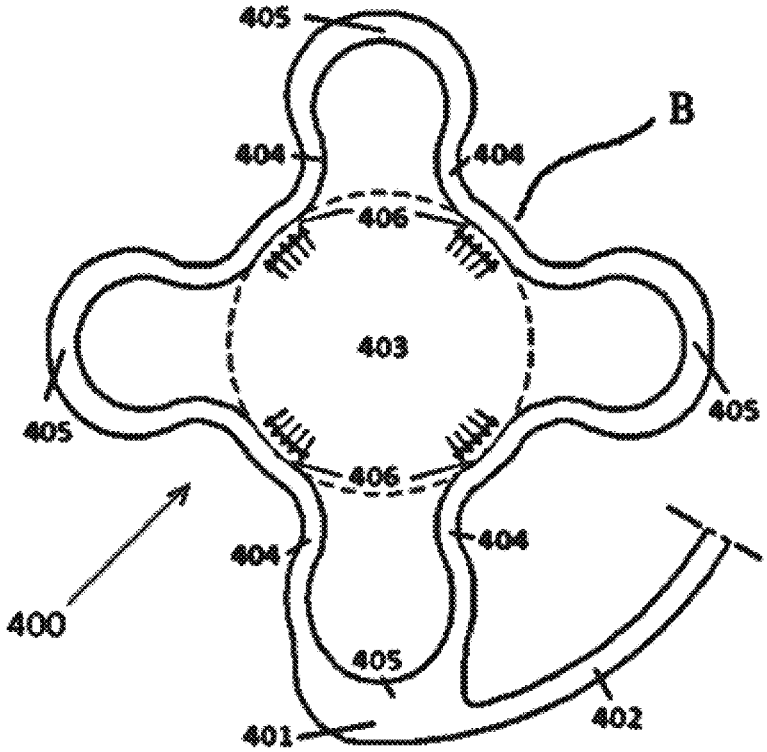
FIGS. 4*a* and 4*b* show a second embodiment a collet according to the present invention.
Figure 4B:
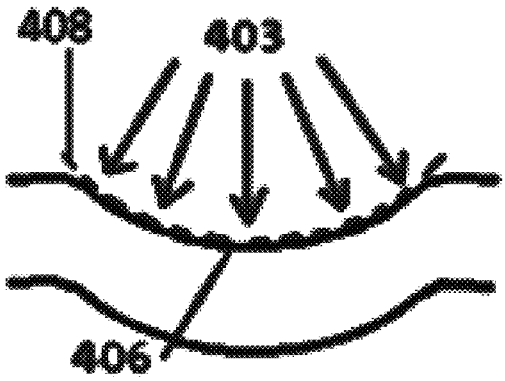

A second embodiment of the present invention is shown in FIGS. 4*a* and 4*b*, whereby which the hairspring collet 401 has 4 elastic arms distributed in an equally spaced apart arrangement. The configuration of the present embodiment is similar in structure as the embodiment as described in reference to FIGS. 2*a* and 2*b*, whereby the hairspring assembly 400 is composed of a collet 401 and a hairspring 402 extending outwardly.

The collet 401 is formed of four elastic arms 404, which are provided with specific predetermined curvature in order to both minimize the stress induced as represented by the radially extending arrows from engagement with a staff surface 408 and provide elastic deformation, and which are connected to each other at junctions 405.

For each arm, a "cup" structure portion 406 is designed such that it may be closely contact with the balance staff that is located at the center open zone 403.

Figure 5:
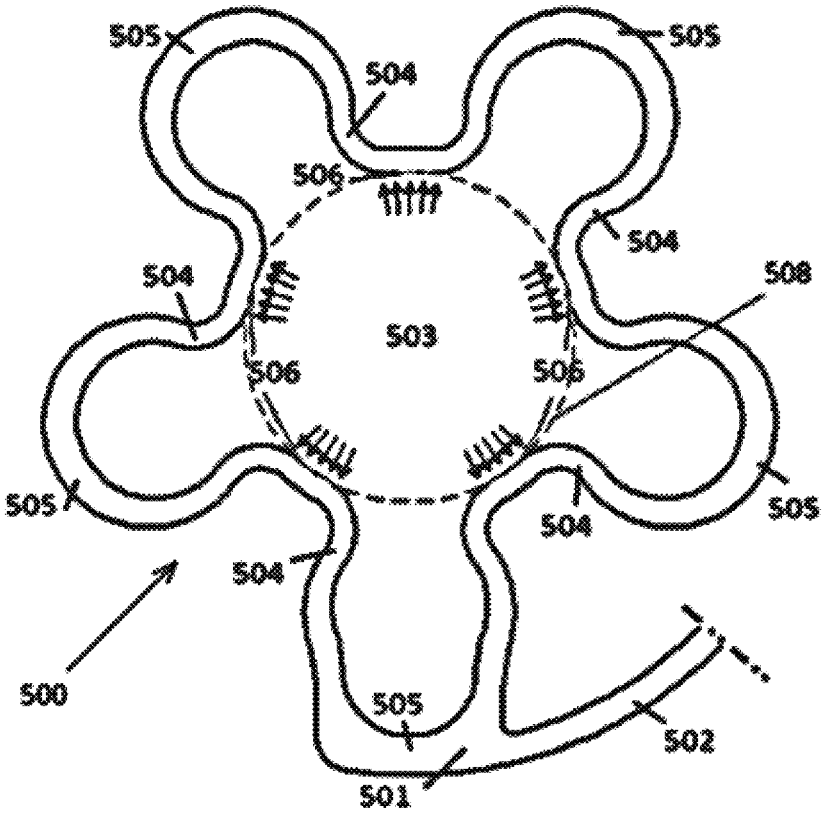
FIG. 5 shows a third embodiment of a collet according to the present invention.
Figure 6A:
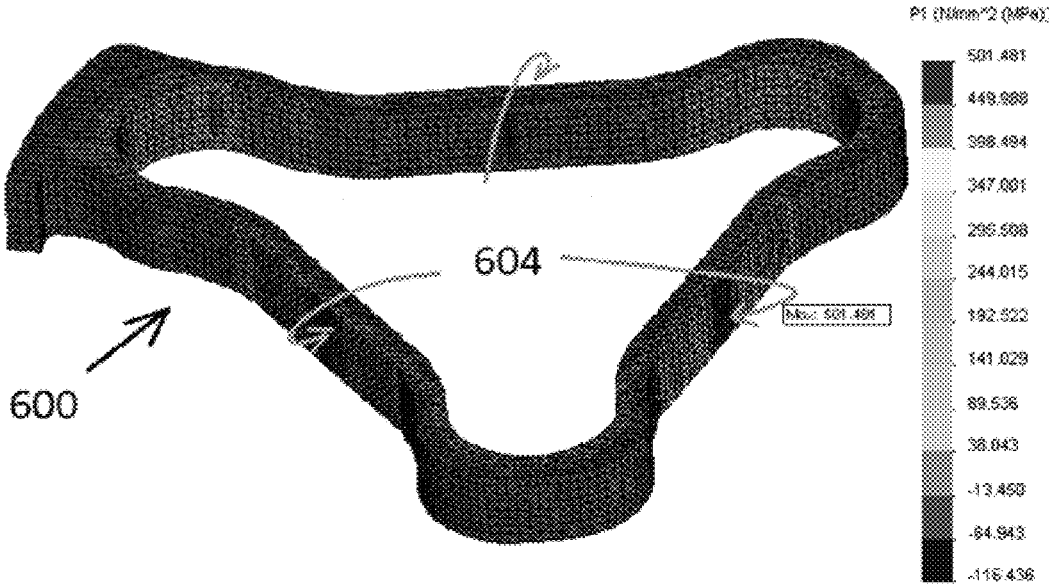
FIGS. 6*a*-6*d* depicts numerical computational stress analysis of a silicon collet according to the present invention in comparison to a collet according to the prior art.
Figure 6B:
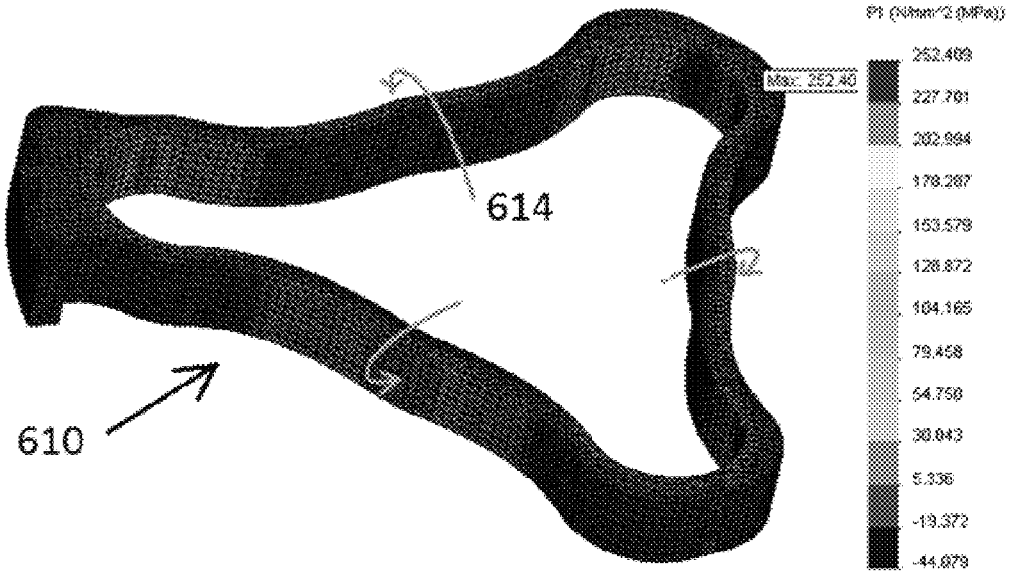
Figure 6C:
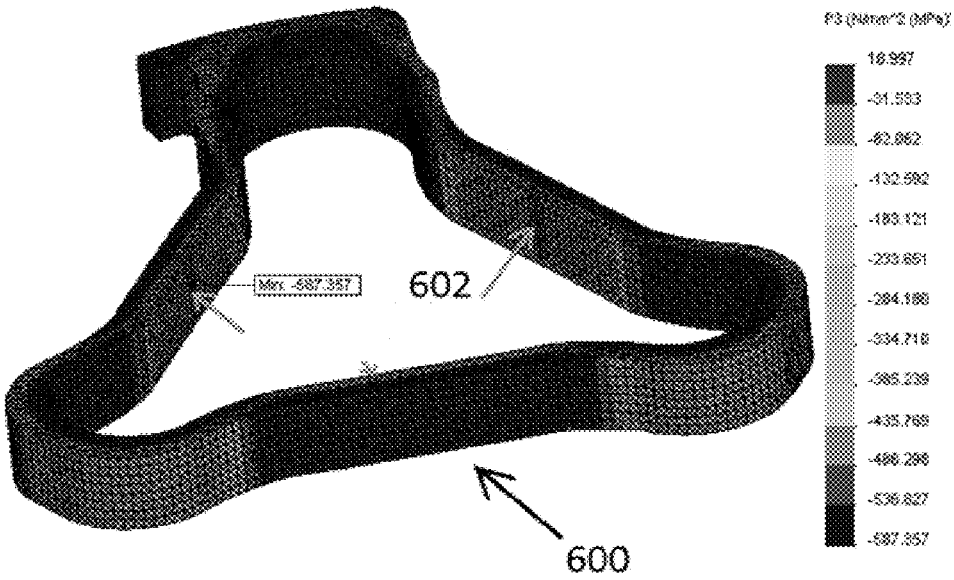
Figure 6D:
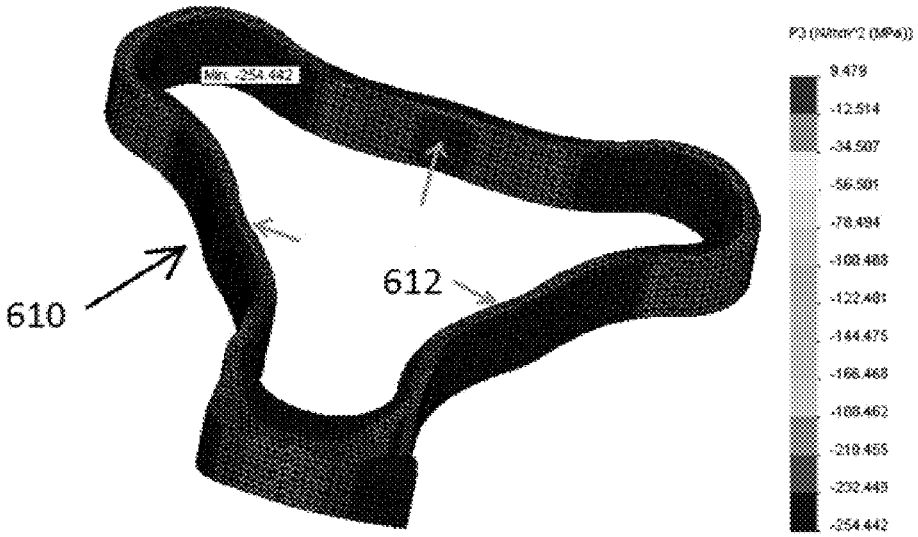
Figure 7A:
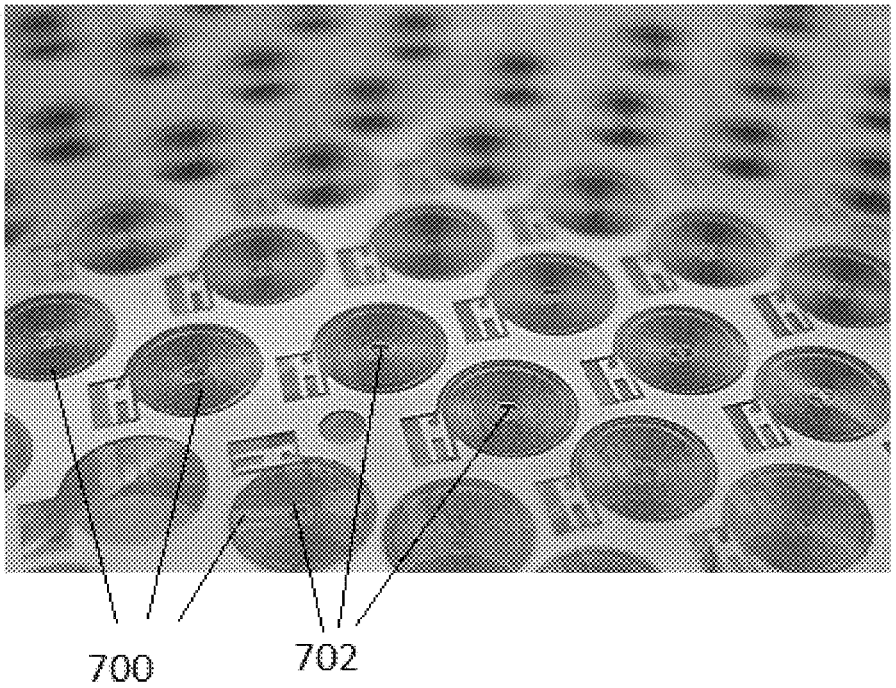
FIGS. 7*a*-7*e* depict details of experimental analysis of a collet in accordance with the present invention in comparison with collets of the prior art, when viewed by optical CMM.
Figure 7B:
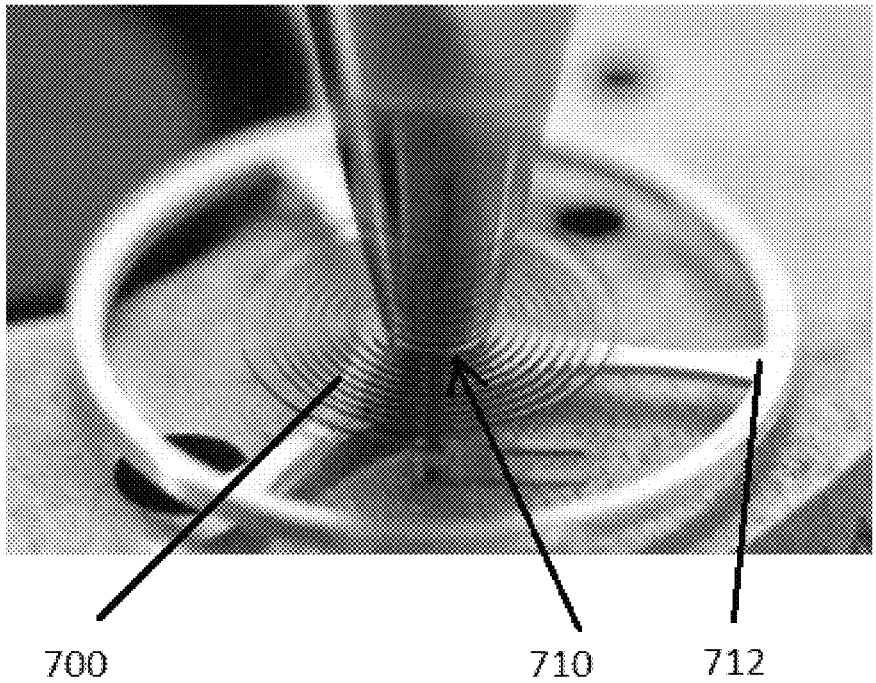
Figure 7C:
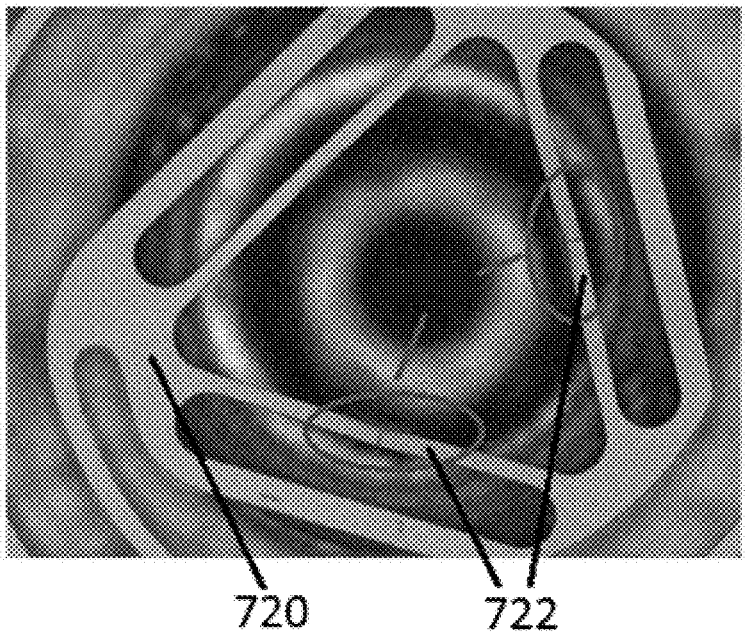
Figure 7D:
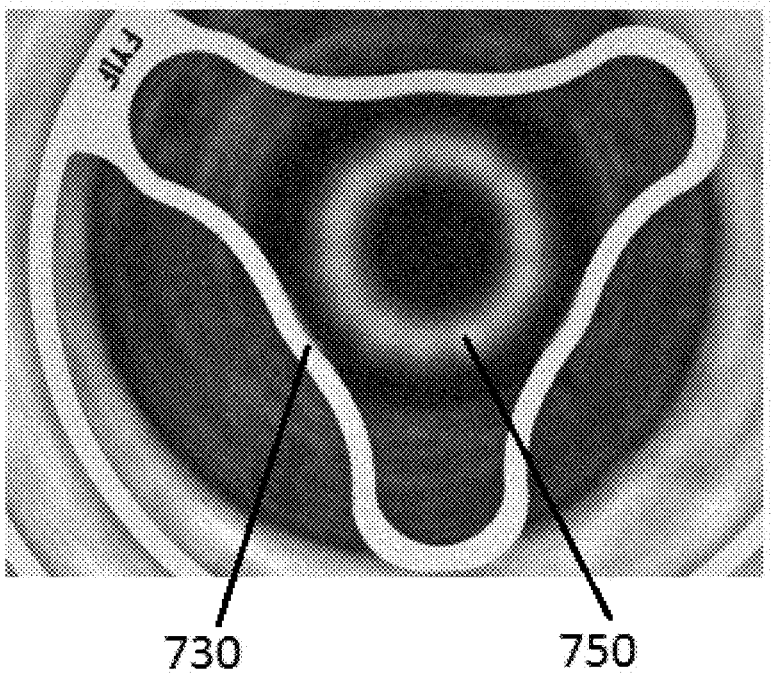
Figure 7E:
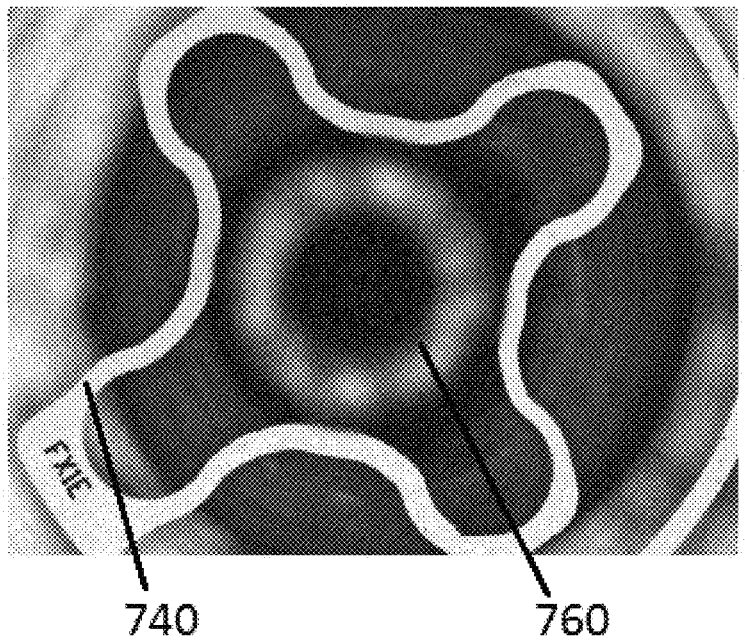

FIG. 5 shows a third embodiment of a collet 500 according to the present invention, with the collet 500 having five "cup" structure elastic arms 504.

The collet body 501 is joined with a hairspring inner coil 502, wherein the collet body 501 is formed from five "cup" portions 506 and elastic arms 504 therebetween, and the elastic arms 504 are connected at junctions 505.

During timepiece assembly, the balance staff 508 is inserted in the open zone 503 such that the hairspring collet 500 contacts with the staff at "cup" portions 506, similarly as described with reference to the first and second embodiments of the invention above, to both minimize the stress induced as represented by the radially extending arrows from engagement with a surface of balance staff 508 and provide elastic deformation Referring to FIGS. 6(*a*)-6(*d*), a comparison between a conventional silicon collet 600 and a silicon collet 610 according to the present invention is provided utilising numerical stress analysis techniques.

In the model as used, the following parameters were utilised:

STAFF: Steel, Radius—0.25 mm, Height 0.1 mm, Modulus of Elasticity 200 GPa

COLLET: Silicon, Arm width 0.035 mm, Radius before deformation 0.245 mm, height 0.1 mm, Length of arc for contact with staff—0.1 mm FIG. 6(*a*) and FIG. 6(*b*) show the principal stress (tensile) induced in a collet according to the prior art 600 and a collet 610 according to the present invention respectively, and FIG. 6(*c*) and FIG. 6(*d*) shown the principal stress (compressive) induced in a collet according to the prior art 600 and a collet 610 according to the present invention respectively.

Computer simulation has been provided in order to model the behaviour of collets according to the prior art 600 and collets 610 of the present invention when fitting to a balance staff.

The resultant principle stress profiles of a silicon collet according to the prior art 600 and collets 610 to the present invention are shown, which were both found to have with same amount of gripping force with the balance staff, verifying the applicability of the comparative model.

However, referring to the results of the conventional collet 600 model according to the prior art as shown in FIG. 6(*a*) and FIG. 6(*c*), which is assembled with the balance staff with just 3 points of contact, the collet 600 suffered from a highly concentrated compressive stress (principle stress 3) of approximately 590 MPa at each elastic arm contact region 602 and also a highly concentrated tensile stress (principle stress 1) of approximately 500 MPa at the adjacent side 604.

Note, failure occurs at high stress concentrations on the arm adjacent contact regions generally, which results in breakage of a collet. Although silicon has an ultimate tensile strength of approximately 7 GPa, it has a high tendency to cleave along crystallographic planes and it is found that a stress of over 300 MPa is likely to cause the collet to fracture and fail.

By comparison, the stress-relieved elastic structure of the collet model of a collet 610 according to the present invention as shown in FIG. 6(*b*) and FIG. 6(*d*) resulted in a substantially lower compressive stress (principle stress 3) of approximately 220 MPa at each elastic arm contact region 612 and a tensile stress (principle stress 1) of approximately 200 MPa at the adjacent side 614 at the 3 cup contact regions and as such, the design as depicted should be safe having relatively low localised stresses.

As has been demonstrated from the computer simulated comparative models as described above, a collet according to the present invention shows a significant reduction stress (60%-70%) while maintaining sufficient gripping force when mounted with a balance staff, demonstrating a significant improvement over the prior art.

Further, in order to verify the simulation results above, different silicon hairspring samples have been prepared by micro-fabrication, and a press-fit experiment conducted to assemble these hairsprings with the balance staff.

FIG. 7 shows photographic representations of the results the details of the experiment done and also the assembled collets and staffs.

Referring to FIG. 7(*a*), there is shown a sample of hairsprings 700 including a collet 702 in accordance with the present invention, which are formed from silicon. The hairsprings 700 are formed by micro-fabrication.

FIG. 7(*b*) depicts a hairspring 700 of FIG. 7(*a*) in accordance with the present invention being assembled with a balance staff 710 and hence balance wheel 712. After the press-fit, the assembled samples are optically checked and examined by using a coordinate measuring machine (CMM).

Referring to FIG. 7(*c*) there is shown a photograph of a conventional collet 720 standard in the art taken utilising CMM. As will be noted, the conventional collet has experienced failure due to a high concentrated stress at the point contact regions 722, which cracked immediately.

In comparison with the collet as shown in FIG. 7(*c*), there are collets 730, 740 as shown in FIG. 7(*d*) and FIG. 7(*e*) as formed in accordance with the present invention which have been press fitted to a balance staff 750, 760. As will be readily observed, compared to the collet of the prior art 720 as shown in FIG. 7(*c*), those of the present invention 730, 740 are well fitted onto each balance staff 750, 760, and no evidence of cracking or fracture exists.

The experimental results as described with reference to FIGS. 7(*c*), 7(*d*) and 7(*e*) demonstrated that the yield rate of fixation of a hairspring to a balance staff for a conventional hairspring of the prior art was 50-60%, in comparison to a yield rate of greater that 90% for the hairsprings having collets according to the present invention. This increase in yield rate is considered a significant advantage over devices of the prior art, providing a hairspring/balance wheel assembly with a significantly lower failure rate during assembly as well as providing more expedited manufacture, Regarding the stress issue in the hairspring-balance staff assembly process, cautious design is needed such that the collet would have enough contact force (avoid sliding) and with minimized stress.

One of the effective directions to tackle it is to improve the contact interface between the balance staff and the collet.

If the hairspring collet has a well-designed contact zone, the press-fit force induced by the balance staff could be shared out evenly over the entire contact zone & also the region nearby, and thus the stress is reduced.

Besides the contact interface, the design of the structure of the collet is paramount.

A design according to the present invention will lower the stress efficiently with minimum deformation on the collet, which requires appropriate estimation and calculation on the mechanism of force and deformation.

Based on those purposes and requirement, the hairspring collet according to the present invention reduces the pressure induced in the hairspring-balance staff assembly process, thus increasing the production yield rate.

While the present invention has been explained by reference to the examples or preferred embodiments described above, it will be appreciated that those are examples to assist understanding of the present invention and are not meant to be restrictive. Variations or modifications which are obvious or trivial to persons skilled in the art, as well as improvements made thereon, should be considered as equivalents of this invention.

The invention claimed is:

1. A hairspring collet for a hairspring for interference engagement and an interference fit with the cylindrical outer surface of the staff of a balance wheel for a timepiece movement, said hairspring collet portion comprising:

a plurality of circumferentially extending elastically deformable interconnected arm portions, the arm portions forming an annulus having a central axis and providing an aperture therebetween, wherein each arm portion including a curved concave engagement portion for engagement with the outer surface of a staff of a balance wheel, wherein each engagement portion has substantially the same radius of curvature as each other and are equally spaced from said central axis at a first distance and wherein said first distance is less than the radius of the staff of the balance wheel;

said engagement portions have a radius of curvature such that upon deformation of the arm portions and engagement with the outer surface of said staff the engagement portions substantially conform with the outer surface of said staff and an interference fit is formed therebetween, wherein stress induced from said interference fit is transferred and distributed from along the engagement portions to the arm portions adjacent the engagement portions and distributed therein; and wherein the interference fit of the engagement portions with the staff substantially prevents relative movement between the hairspring collet and the staff of the balance wheel upon application of load from a hairspring in use in a timepiece movement.

2. A hairspring collet according to claim 1, wherein said stress induced from said interference fit is distributed along the engagement portions and transferred to the adjacent arm portions and the size and dimensions of the arm portions and the engagement portions are such that stress distributed within the arm portions is lower that the failure strength of the material from which the collet is formed.

3. A hairspring collet according to the claim 1, wherein the collet is formed as a unity construct by said arm portions.

4. A hairspring collect according to claim 1, wherein each elastically deformable interconnected arm portion is of equal arm width in the radial direction.

5. A hairspring collet according to claim 1, wherein the hairspring collet is formed from a brittle material including silicon quartz or the like.

6. A hairspring collet according to claim 1, further comprising a temperature compensation layer on the surface of the collet for time compensation due to changes in temperature, and wherein the temperature compensation layer is an addition layer of oxide.

7. A hairspring collet according to claim 1, wherein the collet is formed from micro-fabrication.

8. A hairspring and hairspring collet assembly for a timepiece comprising a hairspring and a hairspring collet according to claim 1.

9. A hairspring and hairspring collet assembly according to claim 8, wherein the collet is formed as a unity construct by said arm portions.

10. A hairspring and hairspring collet assembly according to claim 8, wherein the hairspring inner coil is attached to the collet adjacent a juncture of two arm portions.

11. A hairspring and hairspring collet assembly according to claim 10, wherein the hairspring is formed with the collet as a unitary construct.

12. A hairspring and hairspring collet assembly according to claim 8, wherein the hairspring and hairspring collet is formed from a brittle material including silicon quartz or the like, and wherein the hairspring and hairspring collet assembly is formed from micro-fabrication.

13. A hairspring and hairspring collet assembly according to 8, wherein the hairspring is designed specifically according to specific frequency requisite of a timepiece.

14. An engagement structure of a timepiece component for engagement with the cylindrical surface of a further timepiece component; said engagement structure comprising:

a plurality of circumferentially extending elastically deformable interconnected arm portions, the arm portions forming an annulus having a central axis and providing an aperture therebetween, wherein each arm portion including a curved concave engagement portion for engagement with the cylindrical surface of a further timepiece component, wherein each engagement portion has substantially the same radius of curvature as each other and are equally spaced from said central axis at a first distance and wherein said first distance is less than the radius of the cylindrical surface;

said engagement portions have a radius of curvature such that upon deformation of the arm portions and engagement with the cylindrical surface the engagement portions substantially conform with the outer surface of said cylindrical surface and an interference fit is formed therebetween, wherein stress induced from said interference fit is transferred and distributed along the engagement portions and distributed within the arm portions adjacent the engagement portions; and wherein the interference fit of the engagement portions with the cylindrical surface substantially prevents relative movement between the timepiece component and the further timepiece component in use in a timepiece movement.

15. An engagement structure of a timepiece component according to claim 14, wherein the timepiece component is an hour hand, minute hand, and the second hand or the like.

* * * * *